US010053888B2

(12) United States Patent
Mitchell

(10) Patent No.: US 10,053,888 B2
(45) Date of Patent: Aug. 21, 2018

(54) FENCING STORAGE SYSTEM

(71) Applicant: Paul Mitchell, Collingwood (CA)

(72) Inventor: Paul Mitchell, Collingwood (CA)

(73) Assignee: Ideal Warehouse Innovations, Inc., Woodbridge, Ontario (CA)

( * ) Notice: Subject to any disclaimer, the term of this patent is extended or adjusted under 35 U.S.C. 154(b) by 0 days.

(21) Appl. No.: 14/587,657

(22) Filed: Dec. 31, 2014

(65) Prior Publication Data

US 2015/0115089 A1 Apr. 30, 2015

Related U.S. Application Data

(63) Continuation-in-part of application No. 13/590,240, filed on Aug. 21, 2012, now abandoned.

(51) Int. Cl.

| | |
|---|---|
| ***B65H 75/38*** | (2006.01) |
| ***E04H 17/26*** | (2006.01) |
| ***B65H 75/44*** | (2006.01) |
| ***E01F 13/02*** | (2006.01) |
| ***B65H 75/28*** | (2006.01) |

(52) U.S. Cl.

CPC ..... *E04H 17/266* (2013.01); *B65H 75/28* (2013.01); *B65H 75/38* (2013.01); *B65H 75/4471* (2013.01); *E01F 13/028* (2013.01); *B65H 2701/3912* (2013.01)

(58) Field of Classification Search

CPC .... B65H 75/28; B65H 75/4471; B65H 75/38; B65H 2701/3912; E04H 17/266; E01F 13/028

USPC .... 242/403, 588.6, 395, 397, 398, 405, 406, 242/557, 566, 588, 588.3, 598, 598.5, 242/598.6

See application file for complete search history.

(56) References Cited

U.S. PATENT DOCUMENTS

| | | | | | |
|---|---|---|---|---|---|
| 906,848 | A | * | 12/1908 | Atwell | 473/493 |
| 1,677,515 | A | | 7/1928 | Durand | |
| 1,701,046 | A | * | 2/1929 | Kraus | 242/557 |
| 1,933,163 | A | * | 10/1933 | Coplen | 242/404 |
| 2,108,333 | A | | 2/1938 | Hardin et al. | |
| 4,119,301 | A | * | 10/1978 | Payne | 256/41 |
| 4,595,155 | A | * | 6/1986 | Gough | 242/395.1 |
| 4,993,719 | A | * | 2/1991 | Hernandez | 473/492 |

(Continued)

FOREIGN PATENT DOCUMENTS

| | | |
|---|---|---|
| FR | 2734803 | 12/1996 |
| GB | 2355751 A | 2/2001 |

*Primary Examiner* — William A. Rivera

(74) *Attorney, Agent, or Firm* — The Dobrusin Law Firm, PC

(57) ABSTRACT

A cylindrical cartridge used for the storage and protection of all types of barrier fencing. The device is designed to extend the life of barrier fencing, reduce waste and reduce cost. The cartridge has an interior hollow pipe shaft with rollers mounted to the shaft to create a spool. The spool shaft extends through the top of the cartridge and is fitted with a manually operated crank handle. A vertical slotted opening in the side of the cartridge of varying widths dependent on the barrier material being used allows the extraction and retraction of the barrier fencing. The bottom of the cartridge has an opening in the center equal to that of the interior dimension of the hollow shaft. The bottom opening allows for the mounting of the cartridge to a ground spike or stabilizing plate.

12 Claims, 2 Drawing Sheets

(56) References Cited

U.S. PATENT DOCUMENTS

| | | | | | |
|---|---|---|---|---|---|
| 5,145,122 | A * | 9/1992 | Poister | B65H 75/06 | 24/129 R |
| 5,497,958 | A * | 3/1996 | Orf et al. | 242/597.7 | |
| 5,505,244 | A * | 4/1996 | Thumann | 160/23.1 | |
| 5,660,144 | A | 8/1997 | Venti | | |
| 5,690,317 | A * | 11/1997 | Sandsborg | 256/1 | |
| 5,743,484 | A * | 4/1998 | Baskett | 242/557 | |
| 5,806,779 | A | 9/1998 | Crum | | |
| 6,056,038 | A | 5/2000 | Foster et al. | | |
| 6,142,701 | A * | 11/2000 | Falcon | E01F 13/028 | 160/24 |
| 6,533,215 | B2 * | 3/2003 | Crain | 242/597.7 | |
| 6,536,502 | B2 * | 3/2003 | Britto et al. | 160/23.1 | |
| 6,543,713 | B1 * | 4/2003 | Frolander | B65H 49/32 | 242/397.2 |
| 6,601,638 | B1 | 8/2003 | Lafleur | | |
| 6,733,204 | B1 * | 5/2004 | Paniccia | 404/6 | |
| 6,779,537 | B1 | 8/2004 | Miller | | |
| 6,807,999 | B1 * | 10/2004 | Bowen et al. | 160/24 | |
| 7,082,981 | B2 | 8/2006 | Perez, Jr. | | |
| 7,217,061 | B2 * | 5/2007 | Stratton | 404/6 | |
| 7,377,490 | B1 * | 5/2008 | Khosravian | 256/24 | |
| 2005/0098770 | A1 * | 5/2005 | Schell | E01F 13/028 | 256/25 |
| 2005/0150994 | A1 * | 7/2005 | Lin | G03B 21/62 | 242/586.2 |
| 2006/0131551 | A1 | 6/2006 | Hopp | | |
| 2007/0176158 | A1 | 8/2007 | Robinson | | |
| 2010/0301296 | A1 | 12/2010 | Ratzenberger | | |

* cited by examiner

FENCING STORAGE SYSTEM

FIELD OF THE INVENTION

The invention relates to the field of temporary fencing.

BACKGROUND OF THE INVENTION

It is common practice that barrier fencing is delivered to customers in rolls. Those rolls are delivered with or without a protective covering. The rolls are then cut to length by the end user. Once the barrier fencing is taken out of service it is difficult or at the least very time consuming to rewind the barrier material to a suitably-sized roll. The result is generally an unwieldy bundled section of barrier fencing that is difficult to handle, transport and store and can often become discarded and therefore wasted.

SUMMARY OF THE INVENTION

Forming one aspect of the invention is a system for use with barrier fence. This system comprises: a spool for receiving said fence and having an axis; a housing in which said spool is rotatably mounted, the housing having a slot through which fencing can be fed to the spool and withdrawn from the spool, the housing having an aperture in the base thereof aligned with the axis of the spool; a plate adapted to be disposed upon ground and having an aperture therein; means for releasably connecting the housing to the plate such that, when the plate is disposed on and secured to the ground, the housing is positioned such that the spool extends vertically and the apertures in the spool and housing are aligned; and means for rotating the spool.

According to another aspect of the invention, the means for releasably connecting the housing to the plate can include a wedge shaped adapter mounted to the housing and a wedge shaped receiver mounted to the plate.

According to another aspect of the invention, the system can further comprise a stake, the plate can be adapted to be mounted to the ground by the stake and the housing can be adapted such that, when the plate is mounted to the ground by the stake, the housing is supported against tipping by the stake.

According to another aspect of the invention, the spool can be hollow such that, when the plate is mounted to the ground by the stake, the spool receives the stake.

According to another aspect of the invention, the means for rotating the spool can be defined by a crank coupled to the spool.

DETAILED DESCRIPTION

Figure 1:
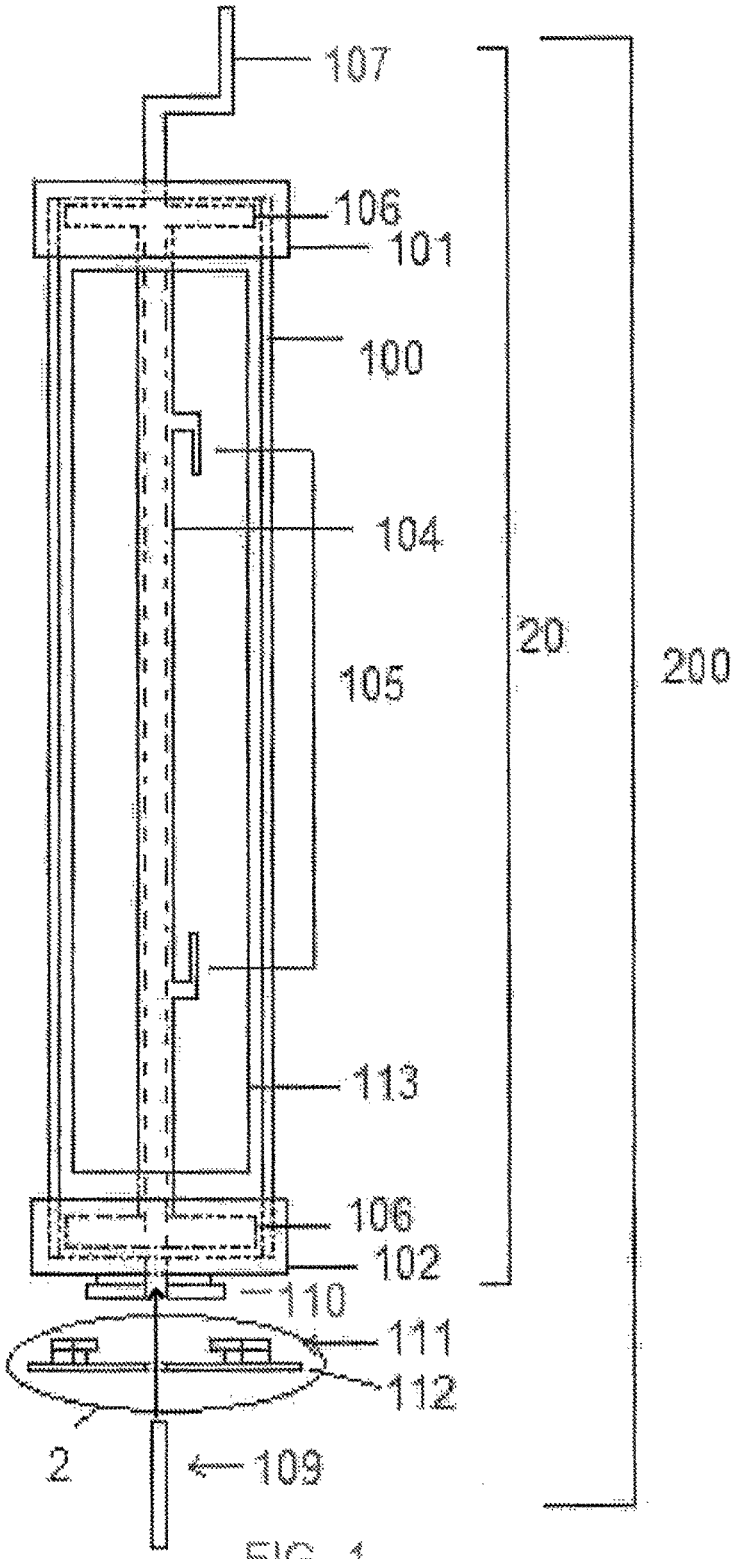
FIG. 1 is a view of the components of a system according to an exemplary embodiment of the invention.
Figure 2:
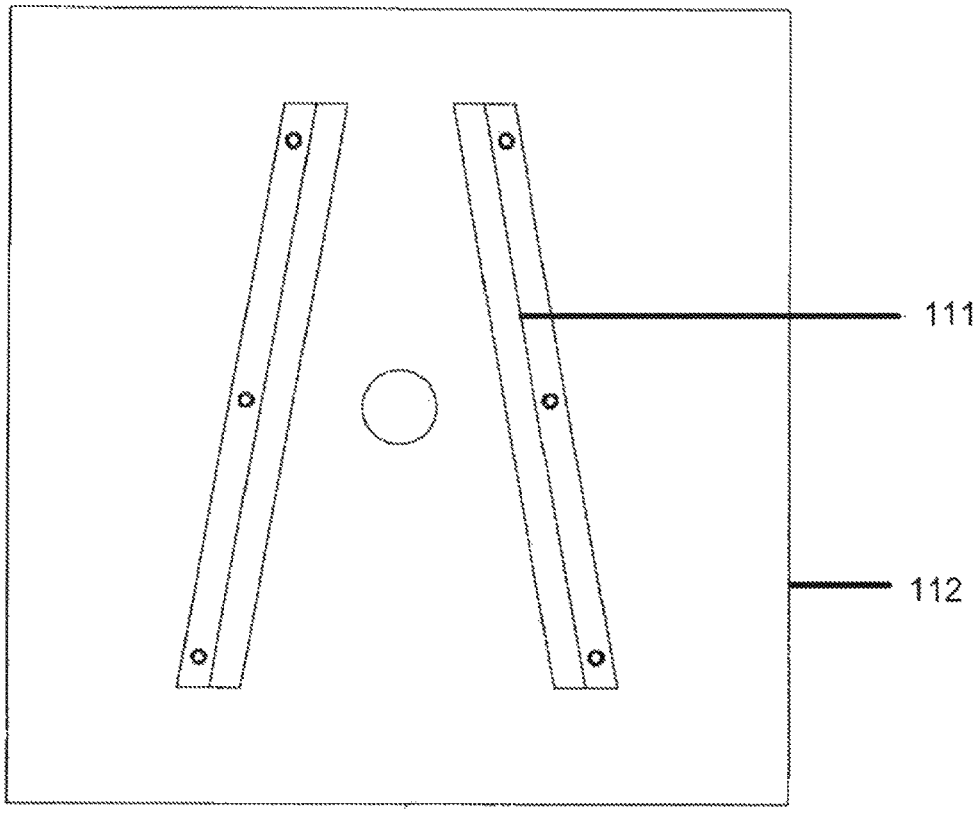
FIG. 2 is a plan view of the structure of encircled area 2 of FIG. 1.

FIG. 1 shows the components of a system 200 according to an exemplary embodiment of the invention, namely, a cartridge 20, a ground stabilizing plate 112 and a ground stake 109.

The cartridge 20 includes a cylindrical shell 100, caps 101 and 102, a shaft 104, rollers 106, a barrier fencing clamp 105 and a crank 107.

The shell 100 is tubular, has threaded ends and has a slotted opening 113 defined therein.

Caps 101 and 102 are screwed to the ends of shell 100. Top cap 101 has an opening therein; bottom cap 102 also has an opening therein and has secured thereto a wedge shaped adaptor 110.

The shaft 104 is hollow and is disposed interiorly of the shell 100. The rollers 106 are disposed at opposite ends of the shaft 104 and define, in combination with the shaft, a spool adapted for rotation in the shell 100. The interior bore of the shaft 104 has a diameter equal to the diameter of the opening of the bottom cap 102.

The barrier fencing clamp 105 is secured to the shaft and is adapted for engaging the barrier fencing [not shown].

The crank handle 107 extends through the opening in the top cap 101 and is coupled to shaft 104; the crank handle 107 thus defines means for rotating the spool to draw fencing material onto the spool, for storage, and to assist in the withdrawal of fencing material from the spool, for use [neither shown].

The ground stabilizing plate 112 has an opening equal to that of the interior dimension of the hollow shaft 104 and has a wedge shaped receiver 111 fitted thereto.

Where ground conditions permit, the stabilizing plate 112 is fixed in place on the ground with the assistance of the ground spike 109, which passes through the opening in the plate 112 into the ground. The cartridge 20 can be threaded onto the projecting end of the ground spike 109, i.e. the ground spike can be passed through the opening in the bottom cap 102 into the bore of the hollow shaft 104. So positioned, the ground spike 109 assists in securing the cartridge against tilting. The engagement between the wedge-shaped receiver 111 and wedge-shaped adapter 110 ensure that the cartridge 20 does not rotate around the axis of the shaft 104, thereby maintaining the fence (not shown) taut.

Where ground conditions do not permit the use of a ground spike the stabilizing plate can be weighted down with sandbags to maintain a fixed position.

Whereas a single embodiment is shown, variations are possible. For example, whereas a specific slot 113 is shown, the slot 113 can be of varying widths, up to 180 degrees, dependent on the type of fencing material used, to allow unimpeded extraction and retraction of the barrier fencing As well, whereas the ground spike is shown as a simple bar, the spike could have a pointed end.

Further, whereas the caps are indicated to be threaded onto the shell, this is not necessary; the caps could equally be secured by glue or sonic welding Yet further variations are possible. Accordingly, the invention should be understood to be limited only by the accompanying claims, purposively construed.

The invention claimed is:

1. A system for use with barrier fence, the system comprising:

a shaft for receiving said fence, said shaft comprising a top end, a bottom end, an axis about which said fence is adapted to be wound, and at least one clamp adapted to engage with, and secure, one end of said fence to said shaft;

a housing in which said shaft is rotatably mounted, said housing comprising a continuous sidewall, a top, a bottom and an elongated slotted opening in said sidewall extending between said top and said bottom, wherein when said one end of said fence is engaged with, and secured to, said shaft, the opposite end of said fence is free and extends through said opening;

means for rotating said shaft wherein when said means for rotating said shaft is activated to rotate said shaft in one direction, said shaft and said fence rotate together in said one direction to wind said fence around said shaft and when said means for rotating said shaft is activated to rotate said shaft in the opposite direction, said shaft and said fence rotate together in said opposite direction to unwind said fence from said shaft; and a base adapted to be releasably connected to said housing and disposed upon a surface to position the housing such that said shaft extends vertically and said housing is supported against tipping, wherein said housing comprises at least one adaptor on the bottom thereof and said base comprises at least one receiver thereon which matingly receives said at least one adaptor to releasably connect said base to said housing.

2. The system of claim 1, wherein said at least one clamp is two clamps.

3. The system of claim 1, wherein the means for rotating said shaft is a crank coupled to said shaft.

4. The system of claim 3, wherein said housing comprises an aperture in the top thereof collinearly aligned with the axis of said shaft through which the handle of said crank extends to couple said crank to said shaft.

5. The system of claim 1, wherein said housing is cylindrical.

6. The system of claim 1, wherein said opening extends up to 180 degrees around the housing about the axis.

7. The system of claim 1, further comprising a stake to be inserted into a surface to dispose said base upon said surface to position said housing such that said shaft extends vertically and said housing is supported against tipping.

8. The system of claim 7, wherein said stake is adapted to be releasably connected to said housing.

9. The system of claim 8, wherein said housing comprises an aperture in the bottom thereof collinearly aligned with the axis of said shaft and said base comprises an aperture therein collinearly aligned with said bottom aperture and wherein at least the bottom end of said shaft is hollow forming an internal bore therein which receives the stake to releasably connect said stake to said housing.

10. The system of claim 9, wherein said stake is threaded into the internal bore of said shaft.

11. The system of claim 1, wherein both the at least one adaptor and the at least one receiver are wedge-shaped.

12. The system of claim 1, wherein said shaft further comprises rollers disposed at opposite ends of said shaft and defining, in combination with said shaft, a spool for rotation within said housing.

* * * * *